US009508495B2

(12) United States Patent
Philip et al.

(10) Patent No.: US 9,508,495 B2
(45) Date of Patent: Nov. 29, 2016

(54) DOUBLE BREAK CONTACT SYSTEM FOR MOULDED CASE CIRCUIT BREAKERS

(75) Inventors: Anoop Philip, Mumbai (IN); Mukul Gupta, Mumbai (IN)

(73) Assignee: LARSEN & TOURBO LIMITED, Mumbai (IN)

( * ) Notice: Subject to any disclaimer, the term of this patent is extended or adjusted under 35 U.S.C. 154(b) by 0 days.

(21) Appl. No.: 14/388,858

(22) PCT Filed: Sep. 11, 2012

(86) PCT No.: PCT/IB2012/054707

§ 371 (c)(1),
(2), (4) Date: Sep. 29, 2014

(87) PCT Pub. No.: WO2013/144686

PCT Pub. Date: Oct. 3, 2013

(65) Prior Publication Data

US 2015/0077199 A1 Mar. 19, 2015

(30) Foreign Application Priority Data

Mar. 28, 2012 (IN) ..... 0911/MUM/2012

(51) Int. Cl.

| | |
|---|---|
| ***H01H 1/20*** | (2006.01) |
| ***H01H 1/025*** | (2006.01) |
| ***H01H 71/02*** | (2006.01) |
| *H01H 77/10* | (2006.01) |

(52) U.S. Cl.

CPC ..... *H01H 1/205* (2013.01); *H01H 1/025* (2013.01); *H01H 1/2041* (2013.01); *H01H 1/2058* (2013.01); *H01H 71/025* (2013.01); *H01H 77/104* (2013.01)

(58) Field of Classification Search

CPC .... H01H 1/20; H01H 1/2008; H01H 1/2016; H01H 1/2025; H01H 2001/2033; H01H 1/2041; H01H 1/205; H01H 1/2058; H01H 71/025; H01H 71/24; H01H 77/104

See application file for complete search history.

(56) References Cited

U.S. PATENT DOCUMENTS

| | | | | |
|---|---|---|---|---|
| 7,189,935 | B1 | 3/2007 | Hassan | |
| 2009/0000933 | A1 * | 1/2009 | Soundararajan ..... | H01H 1/205 200/400 |
| 2009/0057112 | A1 * | 3/2009 | Bennett ..... | H01H 77/104 200/244 |

FOREIGN PATENT DOCUMENTS

| | | | | |
|---|---|---|---|---|
| DE | 102011075655 | A1 | 2/2012 | |
| EP | 0853327 | A2 | 7/1998 | |
| EP | 1288990 | A2 | 3/2003 | |
| FR | EP 0314540 | A1 * | 5/1989 | ..... H01H 1/205 |

OTHER PUBLICATIONS

PCT International Search Report and the Written Opinion dated Dec. 21, 2012 (Application No. PCT/IB2012/054707).

* cited by examiner

*Primary Examiner* — Mohamad Musleh

(74) *Attorney, Agent, or Firm* — The Dobrusin Law Firm, PC

(57) ABSTRACT

The invention relates to an improved double break contact system for use in moulded case circuit breakers. The system comprises shaft means (8), fixed contact means (1 and 2) and moving contact means (3) mounted on shaft means (8), spring means (4) operatively mounted on the shaft means (8), holder means (5) securing said spring means (4) wherein holder means being rotatably mounted on the shaft means in a manner that rotation of the shaft means in operation rotates said holder means. The spring means is adapted to provide force opposing the electromagnetic.

6 Claims, 13 Drawing Sheets

DOUBLE BREAK CONTACT SYSTEM FOR MOULDED CASE CIRCUIT BREAKERS

TECHNICAL FIELD OF THE INVENTION

The present invention generally relates to contact system for circuit breakers, mainly moulded case circuit breakers (MCCBs). More particularly, the invention is concerned about a contact system comprising a spring arrangement where the moving contact flips open during short circuit condition.

BACKGROUND AND THE PRIOR ART

Circuit breakers are used for switching and protection of electrical equipments. It consists mainly of current sensing means, mechanism and contact system. The contact system consists of a set of fixed contacts and a moving contact. During any fault (short-circuit) in the line, the moving contact is opens up and clears the fault. During ON condition, a set of springs provide contact force to maintain the moving contact in ON condition. Different arrangements of springs are followed currently for maintaining contact pressure.

Nowadays the contact system is made in such a way that the moving contact repels open during any fault in line due to electromagnetic forces. During this movement the electromagnetic force has to fully act against the springs providing contact pressure.

The different means of contact arrangement currently in use are shown in FIGS. 1(*a*) to 1 (*d*) with reference to the prior patent documents.

U.S. Pat. No. 5,534,832 discloses a switch having at least one power switching pole includes a contact bridge cooperating with fixed contacts and adapted to be maneuvered either by mobile parts of a solenoid or by a tripping mechanism. The contact bridge is rotatable and the mobile parts of the solenoid operate the contact bridge through the intermediary of a transmission mechanism. Referring FIG. 1*a* it would be found that the contact system is compression spring based non flappable type.

U.S. Pat. No. 5,310,971 discloses a molded case low voltage circuit breaker comprising a rotary contact bridge, a pair of stationary contacts cooperating with the contact bridge, current input conductors to the stationary contacts arranged to generate electrodynamic forces repelling the contact bridge to a repelled open position when a short-circuit occurs, a rotary bar having a transverse orifice housing with clearance the contact bridge which protrudes out from both sides of the bar, at least one pair of tension springs fitted between the bar and the contact bridge to provide a contact pressure of the contact bridge on the stationary contacts in closed position of the circuit breaker, while allowing rotation of the contact bridge to the repelled open position due to the electrodynamic forces. However, the system of the prior art is extension spring based. Reference is drawn to FIG. 1*b*.

U.S. Pat. No. 6,870,112 discloses a low-voltage circuit breaker that allows optimum execution of the electrical switching operations, allowing in particular to eliminate or at least minimize the possibility that in short-circuit conditions the moving contact bounces toward the fixed one, with consequent restriking of the electric arc, with a constructive structure that is simple and functionally effective and does not require additional latching elements during opening. The contact system described in this prior art document is extension spring and profile based as shown in FIG. 1*c*.

U.S. Pat. No. 7,394,032 discloses an electrodynamically tilting contact system for power circuit breakers, especially for current-limiting circuit breakers, in which a breaker shaft segment, a rotary contact bridge pivotably mounted therein and contact force springs constitute components of a tilting snap-action mechanism that holds the rotary contact bridge in a repulsed position after the fixed contacts have been electrodynamically repulsed. The prior system is a compression spring based profile type contact system as shown in FIG. 1*d*.

The main limitations of the existing arrangements are:

- Most of the configurations have a continuously opposing spring force against the electromagnetic repulsion force giving less opening speed. (There is no flip locking)
- Contact pressure for most of the configurations is provided by extension springs which are comparatively complex in construction and less accurate. Also no flip locking is possible in simple construction using extension springs.
- The absence of flip locking in many of the configurations can result in contact not remaining in the final repelled condition after the fault has been cleared and current comes to zero.
- Even in cases where flip locking has been proposed the holding arrangement of springs are made in ways which could bring instability in contacts and increased friction occurs.
- All the above drawbacks of conventional arrangements also translate into lesser contact opening during a fault which makes clearing higher faults difficult. (If the contacts open more, more arc voltage is obtained which helps in easier fault clearance).

FIG. 1*a* and 1*d* shows compression spring based shaft construction, where as FIG. 1*b* and 1*c* shows extension spring based shaft construction. The arrangement shown in FIG. 1*a* is a non flappable type of contact system. This causes the spring to continuously oppose the moving contact, thus reducing the efficiency of short circuit breaking. The arrangement shown in FIGS. 1*b* and 1*c* are profile based systems in which the springs apply contact pressure through cam action. This causes increased friction on the contacts, thus reducing the efficiency of short circuit breaking. The arrangement shown in Fig ld is a compression spring based system. But the force is transferred to contact through cam action. This can lead to non stability of moving contact and can also increase friction.

In a conventional system, when contact button wear out due to short circuit or normal switching, the contact springs adjust to push the contact further closing the contact. Due to this adjustment, a part of contact pressure is lost. FIG. 2 shows the variation of contact pressure with erosion for a conventional system. This decrease in contact pressure causes increased resistance between contacts. This causes problems of higher temperature rise in the breaker. This also increases the burden on other components in the breaker.

The conventional technology for shaft construction uses an open shaft construction or partially closed construction. For rotation of moving contact with respect to the shaft, there has to be an opening in the shaft with slot length depending on degree of rotation of moving contact. This produces the following problems:

1. During arcing hot gases and arc products are produced which can enter inside the shaft damaging the components like springs and pins inside the shaft.
2. An open construction leads to lesser differential pressure on arc, i.e. the pressure difference between the front and rear of arc will be lesser. Increased differential pressure is required for efficient driving of arc into the extinguishing zone.
3. An open shaft construction increases the chance of standing arc because of lesser insulation between the contacts.

Therefore, there exists a need of a contact system comprising a spring arrangement where the moving contact flips open during short circuit condition. Further the contact system of the present invention would be able to address all the limitations of the prior art as discussed hereinabove.

The present inventors have found that a spring arrangement can be uniquely designed in such a way that, for initial opening of contact system the spring force opposes the electromagnetic force and then after that aids the electromagnetic force. This arrangement helps in an increased opening velocity, which in turn helps in better breaking. The inventors have also found that in the newly designed double break contact system the contact pressure is maintained even after wear out of the contacts. This would help the breaker in maintaining the same level of performance even after erosion of contacts. Further the construction of the present invention has been provided with a movable shaft cover which rotates along with the moving contacts during repulsion when there is a short circuit.

OBJECTS OF THE INVENTION

A basic object of the present invention is to overcome the disadvantages/drawbacks of the known art.

Another object of the present invention is to provide an improved double break contact system for moulded case circuit breakers.

Another object of the present invention is to provide a holder arrangement such that the system attains maximum stability.

Another object is to provide minimal friction effect.

These and other advantages of the present invention will become readily apparent from the following detailed description read in conjunction with the accompanying drawings.

SUMMARY OF THE INVENTION

The following presents a simplified summary of the invention in order to provide a basic understanding of some aspects of the invention. This summary is not an extensive overview of the present invention. It is not intended to identify the key/critical elements of the invention or to delineate the scope of the invention. Its sole purpose is to present some concept of the invention in a simplified form as a prelude to a more detailed description of the invention presented later.

There is provided an improved double break contact system for moulded case circuit breakers.

According to one aspect of the present invention there is provided an improved double break contact system for use in moulded case circuit breakers, said system comprising:

shaft means;

fixed contact means and moving contact means, said moving contact means being mounted on said shaft means such that said moving contact means rotate with respect to the movement of the shaft means;

spring means operatively mounted on the said shaft means;

holder means securing said spring means;

wherein said holder means being rotatably mounted on said shaft means in a manner that rotation of said shaft means in operation rotates said holder means wherein said spring means is adapted to provide force opposing the electromagnetic force as well as force aiding the electromagnetic force.

BRIEF DESCRIPTION OF THE ACCOMPANYING DRAWINGS

So that those having ordinary skill in the art will more readily understand how to construct a contact system comprising a spring arrangement where the moving contact flips open during short circuit condition in accordance with the present disclosure, exemplary embodiments are described in details herein below with reference the accompanying drawings wherein:

FIGS. 1*a* to 1*d* illustrate contact systems of the prior art.

DETAILED DESCRIPTION OF THE ACCOMPANYING DRAWINGS

The following drawings are illustrative of particular examples for enabling methods of the present invention, are descriptive of some of the methods, and are not intended to limit the scope of the invention. The drawings are not to scale (unless so stated) and are intended for use in conjunction with the explanations in the following detailed description.

Figure 1A:
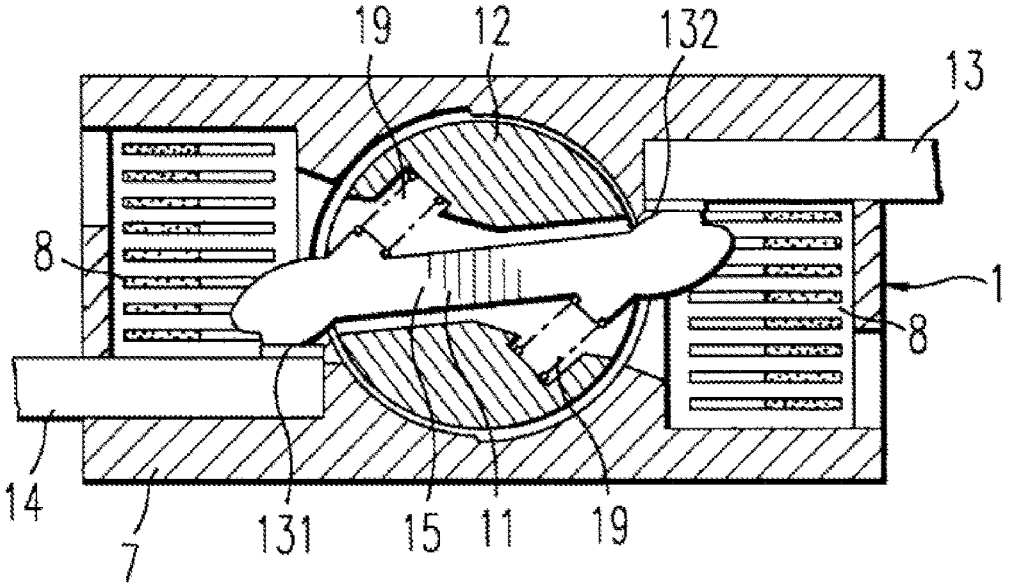
Figure 1B:
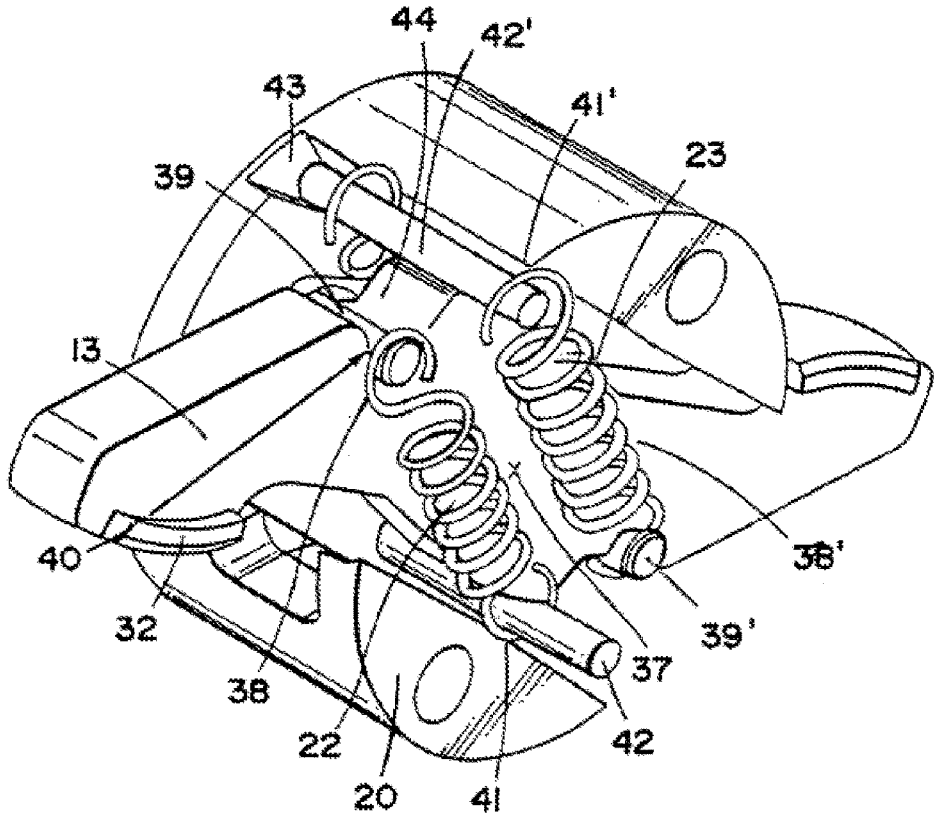
Figure 1C:
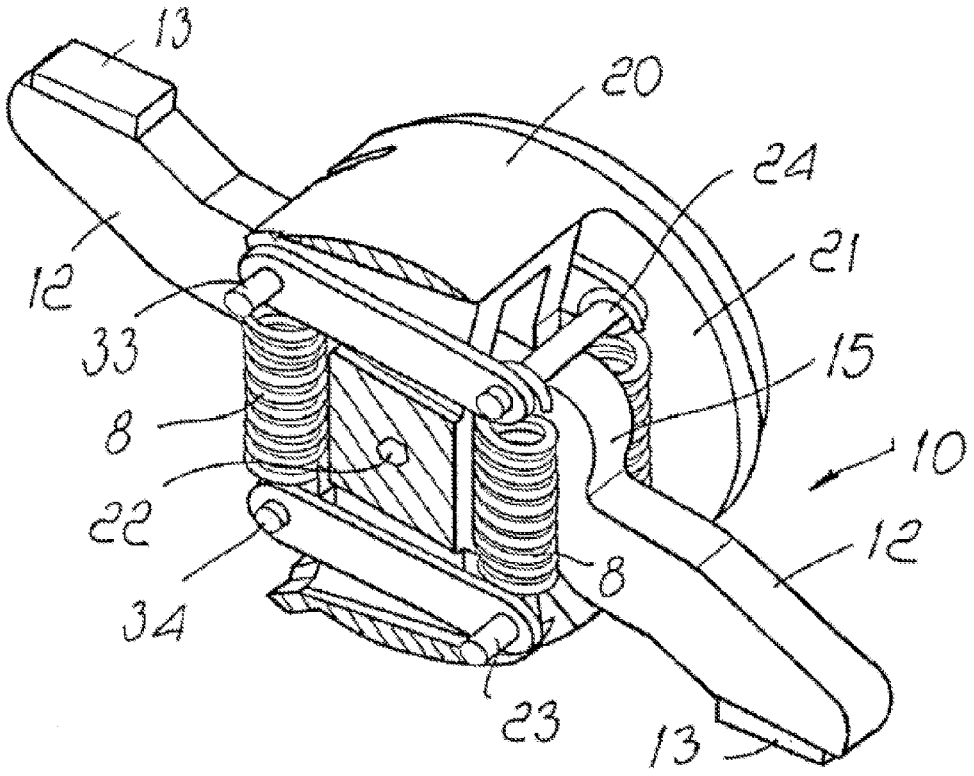
Figure 1D:
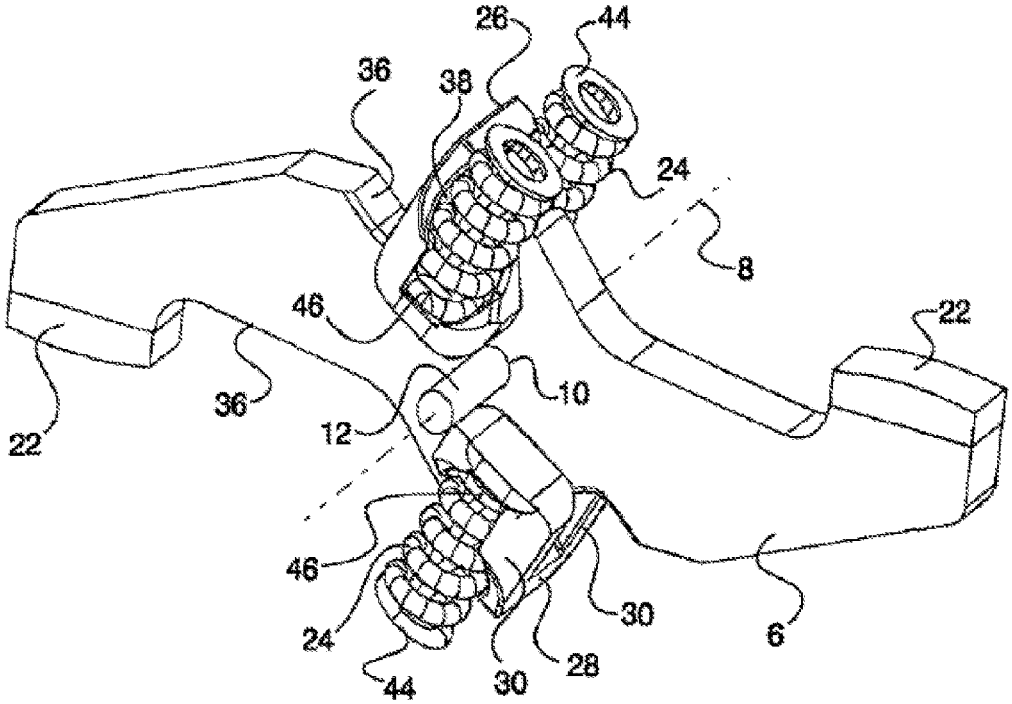
Figure 2:
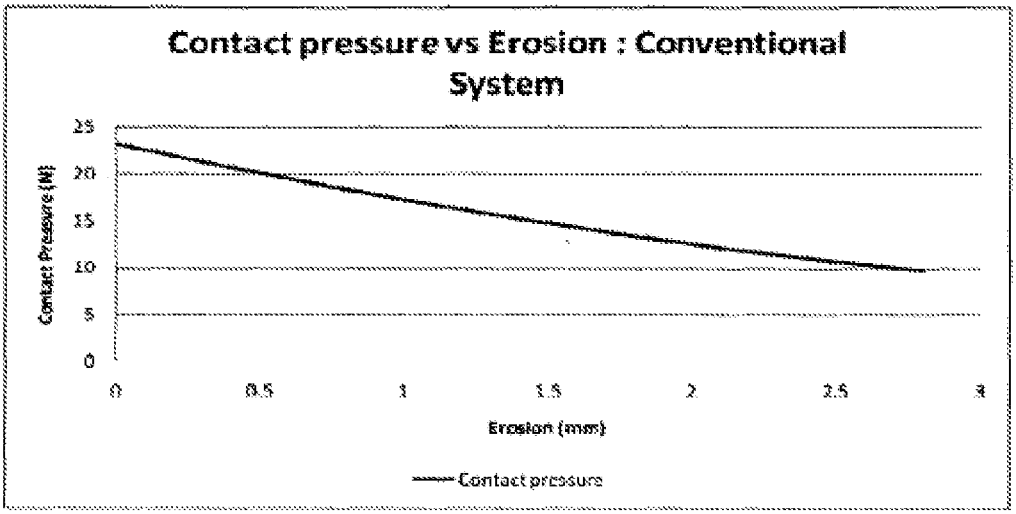
FIG. 2 illustrates the variation of contact pressure with erosion for a conventional system.
Figure 3:
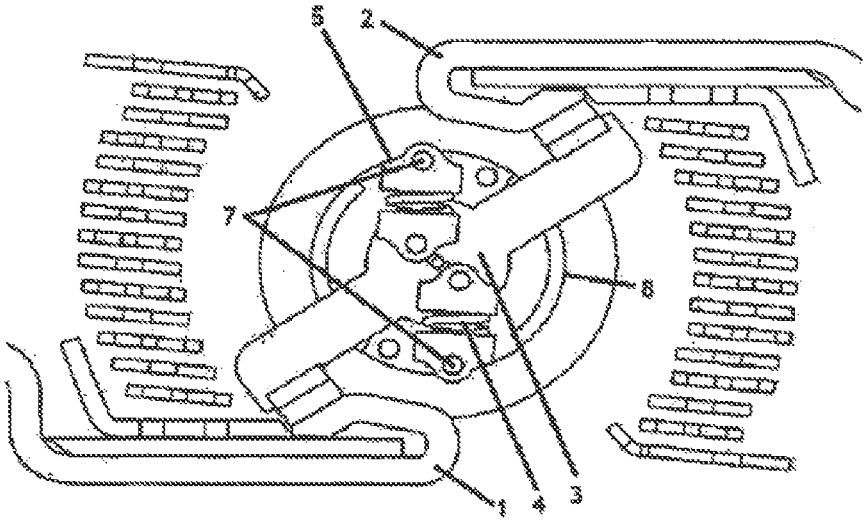
FIG. 3 illustrates the double break contact system according to the present invention in ON condition for use in moulded case circuit breakers.
Figure 4:
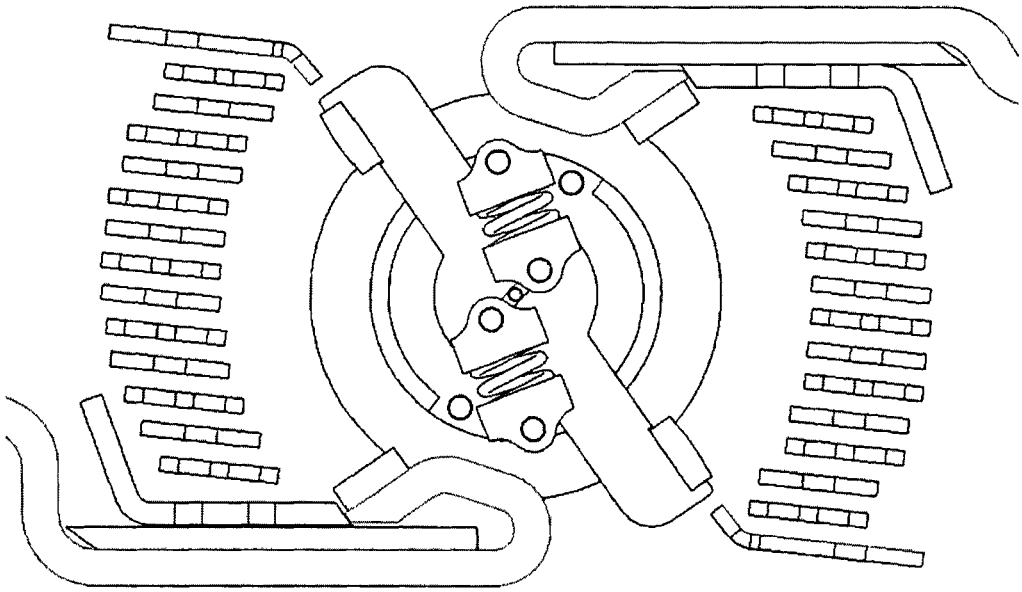
FIG. 4 illustrates the double break contact system according to the present invention in repelled condition.
Figure 5:
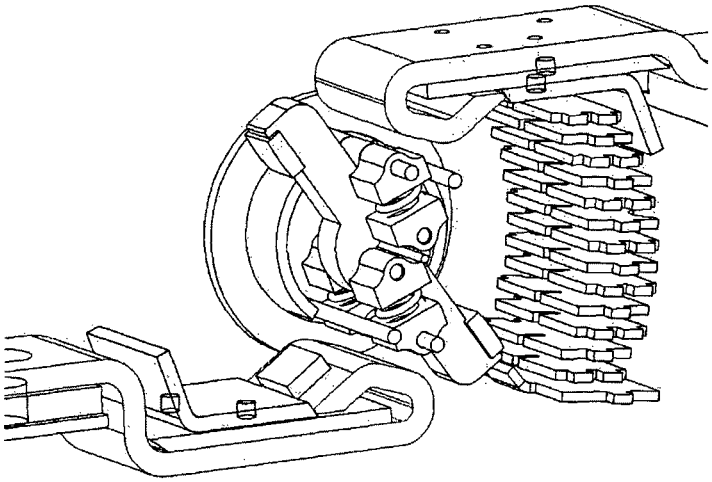
FIG. 5 illustrates isometric view of the double break contact system of the present invention.
Figure 16:
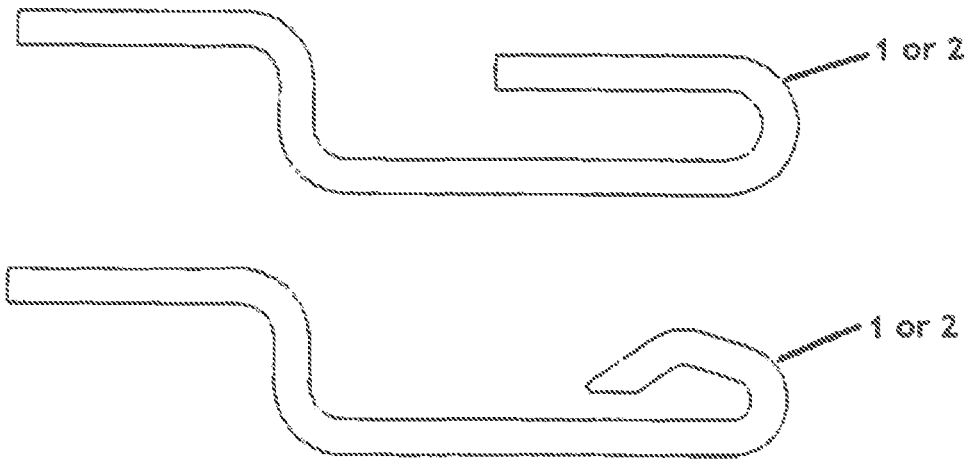
FIG. 16 illustrates design of the fixed contact used in the contact system of the present invention.

FIG. 3 shows the new MCCB contact system in ON condition. The current conduction happens through the fixed contact (1) onto the moving contact (3) and again to the second fixed contact (2). The compression spring (4) arranged between the holders (5) provide the contact force required to maintain the pressure between moving contacts (3) and fixed contacts (1 and 2) to desired levels. The contacts are designed (as in most of present MCCBs) in such a way that during short circuit conditions, an electromagnetic force acts between the moving contact and the fixed contacts. This force rotates the moving contact and brings it to repelled position as shown in FIG. 4. In the present invention the fixed contact has been designed such that it helps in increasing the contact opening as compared to a conventional contact system. As shown separately in FIG. 16 the fixed contacts (1 and 2) have a substantially u shaped profile in which the contact portion which comes in contact with the moving contacts (3) comprises an inward bent portion (6). During the motion the holders (5) rotate on pins (7) mounted on the shaft (8). This arrangement provides easy rotation of holders and helps in channelizing the spring force exactly in the required direction. The moving contact is supported only by the holder arrangement. This enables moving contact to face minimal friction during movement. The arrangement of moving contact is shown in FIG. 5. This type of spring arrangement also enables the system to have a high contact opening than conventional systems. The shaft construction is also much simplified in this arrangement as compared to conventional systems.

Figure 14:
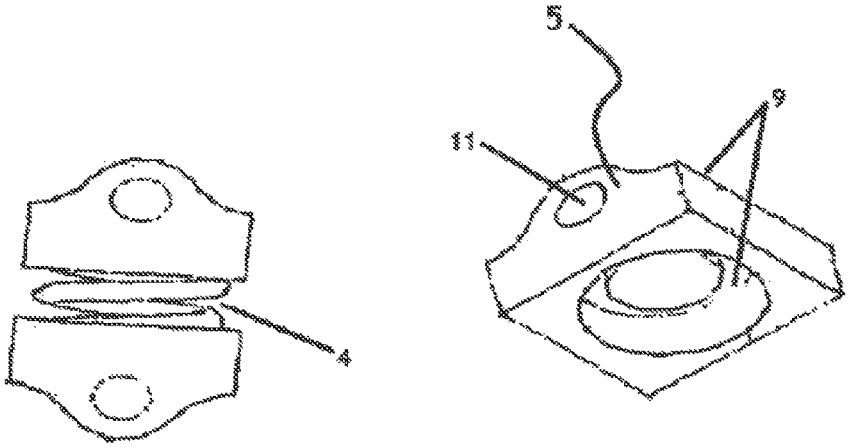
FIG. 14 illustrates the spring holder arrangement in the present invention.

The arrangement of springs on the holder is shown in detail in FIG. 14. The holder arrangement as illustrated in FIG. 14 comprises two substantially rectangular sockets (9) having pins (10) located inside said sockets (9). The springs (4) are mounted on the said pins (10) and secured in the said sockets (9). The sockets (9) further comprise holes (11) at the top for pin mounting the holders on the shaft in a manner that holders are free to rotate on the shaft surface. It is to be noted in this context that the sockets have been described as rectangular in the present embodiment of the invention which should not be considered to be limiting scope of the invention. The shape of the sockets can be anything fulfilling the ergonomics of the other components/parts of the contact system.

Figure 15:
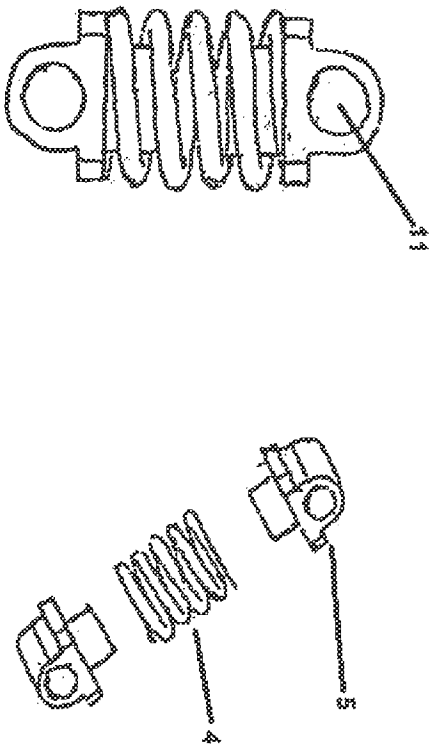
FIG. 15 illustrates an optional spring holder arrangement which can be used in the contact system of the present invention.

A different method of contact arrangement which is possible in this configuration is also shown in FIG. 15. This is a simpler arrangement as compared to the above mentioned concept, but needs more space for implementation. The contact systems are provided with limited space and therefore, the industry demands arrangements which can be functionally fitted in a specified space.

In ON condition Torque due to spring by moving contact is transferred to contact pressure. As contacts wear, due to adjustment by springs, the spring force reduces. For keeping spring torque at the same value, the perpendicular distance form line of action of spring force to shaft centre should increase with erosion. This increase in length should produce a greater increment in torque than what is lost due to decrease in spring force. This is achieved by keeping the spring rate to the lowest possible value.

Figure 6:
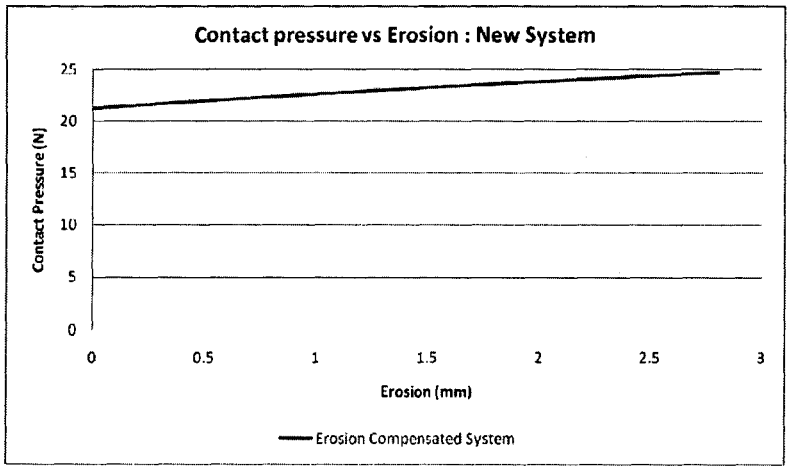
FIG. 6 illustrates the variation of contact pressure with erosion in the contact system of the present invention.
Figure 7:
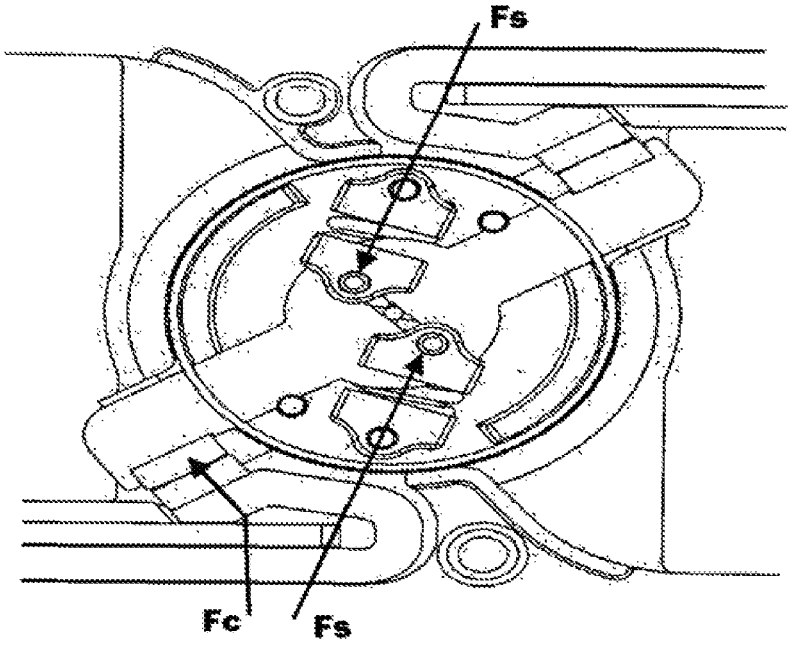
FIG. 7 illustrates the application of force on the spring arrangement of the contact system.

As shown in FIG. 6 the contact pressure increases with erosion.

This gives the following advantages.

1. Improved thermal performance of the breaker due to improved contact pressure.
2. Higher electrical life of breaker due to the ability to perform after erosion.
3. Improved performance after short circuit due to the ability to perform even after erosion.
4. Chance to use less thick button giving option for material saving.

Figure 8:
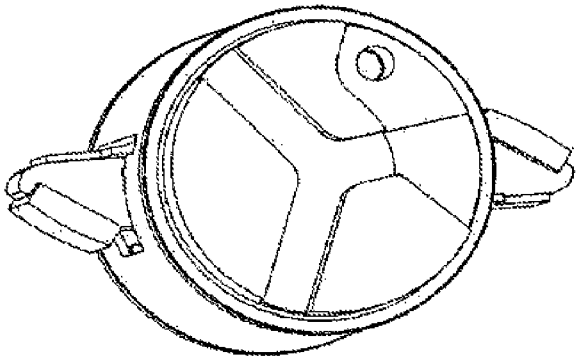
FIG. 8 illustrates enclosed shaft construction.
Figure 9:
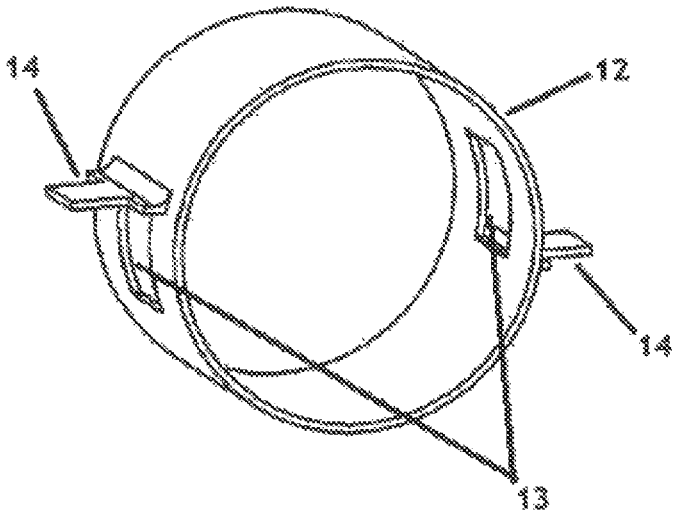
FIG. 9 illustrates shaft cover.
Figure 10:
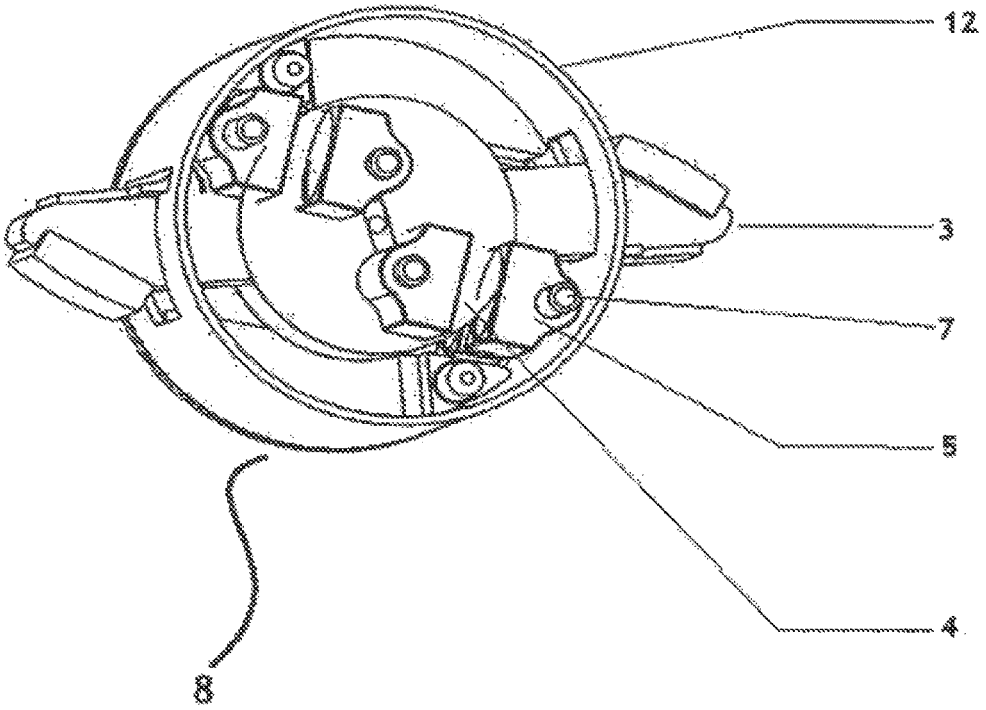
FIG. 10 illustrates one side open view of the enclosed shaft.

FIG. 8 shows enclosed shaft construction wherein the shaft cover (12) (also shown separately in FIG. 9) secures the shaft (8) and moving contact (3). The shaft cover (12) can be in the form of hollow cylinder with slots (13) for insertion of the moving contact (3). The shaft cover can be moulded out of flame retardant thermoplastic materials.

Figure 12:
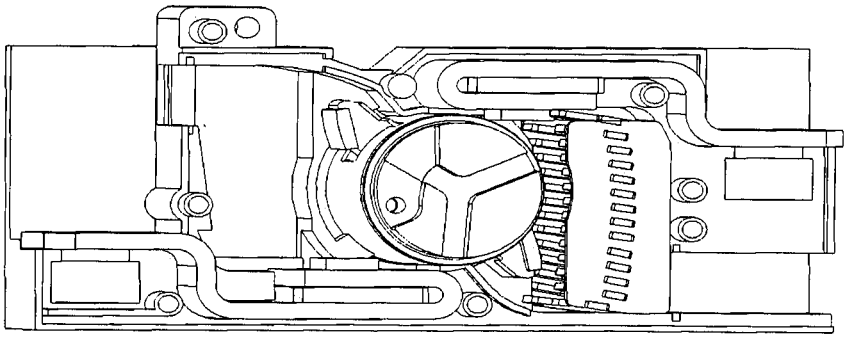
FIG. 12 illustrates a moulded circuit breaker with enclosed shaft with the moving contacts in repelled open position.
Figure 13:
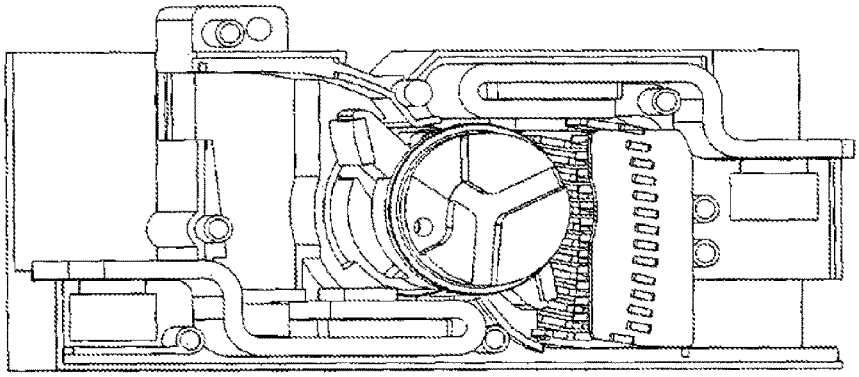
FIG. 13 illustrates a moulded circuit breaker without enclosed shaft with the moving contacts in repelled open position.

During repulsion, the moving contact rotates with respect to the shaft. During this rotation, moving contact touches the shaft cover flap (14) shown in FIG. 9, and thus rotates the shaft cover along with it. When the moving contact opens fully during repulsion as show in FIG. 12, the shaft cover completely encloses the shaft. If shaft cover is not present as shown in FIG. 13, the shaft leaves an open slot after the moving contact has repelled.

The closed construction provides the following advantages

Figure 11:
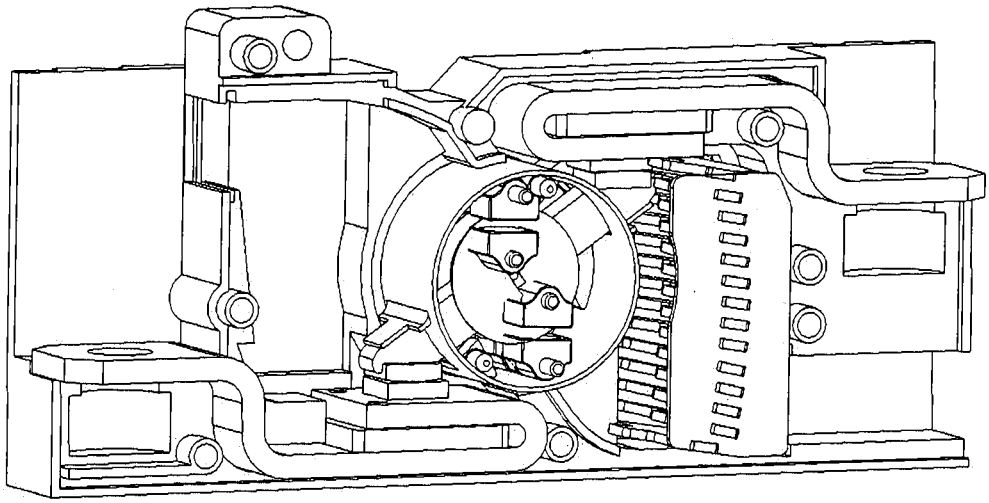
FIG. 11 illustrates a moulded circuit breaker with enclose shaft.

1. It protects the inside components like springs and pins from hot gases and arc products during short circuit arcing.
2. It helps in developing higher pressure behind the arc due to closed region, thus driving the arc away from the shaft into the arc extinguishing region as shown in FIG. 12.
3. It acts as an insulation barrier between live parts during short circuit and prevents standing arc, thus helping the breaker in effective arc quenching. In FIG. 11, there is a possibility of arcing between Points A and B during short circuit. The shaft cover stands as an insulation medium between the two points and hence nullifies the possibility of this arcing.
4. When the moving repels open as shown in FIG. 12, there is a chance of breakdown of air between Point C and Point D, which can lead to standing arc and hence short circuit failure. The shaft cover flap shown in FIG. 6 acts as an insulation barrier between these two points and hence prevents failure.

Although the embodiments herein are described with various specific embodiments, it will be obvious for a person skilled in the art to practice the embodiments herein with modifications. However, all such modifications are deemed to be within the scope of the claims.

It is also to be understood that the following claims are intended to cover all of the generic and specific features of the embodiments described herein and all the statements of the scope of the embodiments which as a matter of language might be said to fall there between.

The invention claimed is:

1. An improved double break contact system for use in moulded case circuit breakers, said system comprising:

shaft means, said shaft means being secured by a cover means;

fixed contact means and moving contact means, said moving contact means being mounted on said shaft means such that said moving contact means rotate with respect to the movement of the shaft means;

spring means operatively mounted on the said shaft means;

holder means securing said spring means, wherein said holder means having two pin means;

wherein said holder means being rotatably mounted on said shaft means by one of said pin means in a manner that rotation of said shaft means in operation rotates said holder means and said holder means mounted on said moving contact arm by another said pin means;

wherein said spring means is adapted to provide force opposing the electromagnetic force as well as force aiding the electromagnetic force.

2. Contact system as claimed in claim 1 wherein said fixed contact means comprising a substantially u shaped profile in which the contact portion which coming in contact with the moving contact means having an inward bent portion.

3. Contact system as claimed in claim 1 wherein said spring means are compression springs.

4. Contact system as claimed in claim 1 wherein said holder means comprising substantially rectangular socket means for accommodation of said spring means.

5. Contact system as claimed in claim 1 wherein said pin means adapted for mounting said holder means on the shaft means in a manner that the said spring means are rotatable with the rotation of said shaft means thereby channelizing the spring force exactly in the required direction.

6. Contact system as claimed in claim 1 wherein said shaft cover means further comprising plurality of shaft cover flap means.

* * * * *